US009850862B2

(12) United States Patent
Senda

(10) Patent No.: US 9,850,862 B2
(45) Date of Patent: Dec. 26, 2017

(54) AIR INTAKE APPARATUS

(71) Applicant: AISIN SEIKI KABUSHIKI KAISHA, Kariya-shi, Aichi-ken (JP)

(72) Inventor: Tomohisa Senda, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 138 days.

(21) Appl. No.: 14/782,941

(22) PCT Filed: Mar. 11, 2014

(86) PCT No.: PCT/JP2014/056354
§ 371 (c)(1),
(2) Date: Oct. 7, 2015

(87) PCT Pub. No.: WO2014/192359
PCT Pub. Date: Dec. 4, 2014

(65) Prior Publication Data

US 2016/0061167 A1 Mar. 3, 2016

(30) Foreign Application Priority Data

May 29, 2013 (JP) ..... 2013-112533

(51) Int. Cl.
*F02M 35/10* (2006.01)
*F02M 35/112* (2006.01)
*F02M 35/104* (2006.01)

(52) U.S. Cl.
CPC .... *F02M 35/10354* (2013.01); *F02M 35/104* (2013.01); *F02M 35/10039* (2013.01);
(Continued)

(58) Field of Classification Search
CPC ..... F02M 35/10354; F02M 35/10144; F02M 35/104; F02M 35/112
(Continued)

(56) References Cited

U.S. PATENT DOCUMENTS 7,131,415 B2 * 11/2006 Enokida ..... F02M 35/10039 123/184.24
2004/0123826 A1 * 7/2004 Yamamoto ..... F02B 27/02 123/184.44
2006/0037575 A1 2/2006 Enokida et al.

FOREIGN PATENT DOCUMENTS

EP 1748167 A2 1/2007
JP 10-339224 A 12/1998
(Continued)

OTHER PUBLICATIONS

International Search Report (PCT/ISA/210) dated Jun. 17, 2014, by the Japanese Patent Office as the International Searching Authority for International Application No. PCT/JP2014/056354.
(Continued)

*Primary Examiner* — Mahmoud Gimie
(74) *Attorney, Agent, or Firm* — Buchanan Ingersoll & Rooney PC

(57) ABSTRACT

The air intake system includes a first piece, an intermediate piece constituting a surge tank and joined to the first piece, and a second piece including an air intake passage upstream portion in communication with the surge tank, the second piece being joined to the intermediate piece. The first piece and the intermediate piece constitute an air intake passage downstream portion in communication with the air intake passage upstream portion. The second piece further includes a flange portion that connects the air intake passage downstream portion and an air intake port of an internal combustion engine.

15 Claims, 5 Drawing Sheets

(52) U.S. Cl.
CPC .... *F02M 35/10144* (2013.01); *F02M 35/112* (2013.01); *F02M 35/10347* (2013.01)

(58) Field of Classification Search
USPC ..... 123/184.21, 184.42, 184.43, 184.47, 123/184.48
See application file for complete search history.

(56) References Cited

FOREIGN PATENT DOCUMENTS

| | | | |
|---|---|---|---|
| JP | 2002-067088 | A | 3/2002 |
| JP | 2005-351166 | A | 12/2005 |
| JP | 2006-57509 | A | 3/2006 |
| JP | 2007-307713 | A | 11/2007 |
| JP | 2009-209762 | A | 9/2009 |
| JP | 2010-285916 | A | 12/2010 |
| JP | 2012-251518 | A | 12/2012 |

OTHER PUBLICATIONS

Written Opinion (PCT/ISA/237) dated Jun. 17, 2014, by the Japanese Patent Office as the International Searching Authority for International Application No. PCT/JP2014/056354.

* cited by examiner

AIR INTAKE APPARATUS

TECHNICAL FIELD

This invention relates to an air intake apparatus.

BACKGROUND ART

Conventionally, an air intake apparatus where a surge tank and an air intake passage are constituted by plural pieces is known. Such air intake apparatus is disclosed, for example, in JP 2012-251518A.

JP2012-251518A discloses a three-piece construction including an upper piece positioned upward, a middle piece positioned midway, and a lower piece positioned downward. In the air intake apparatus, a downstream portion of the air intake passage is constituted by the upper piece and the middle piece. A surge tank and an upstream portion of the air intake passage are constituted by the middle piece and the lower piece. The air intake passage is communicated with the surge tank at the upstream side and is connected to an air intake port of an engine via a flange portion that is provided at an end portion of the downstream portion.

In JP2012-251518A, the flange portion is integrally formed at the middle piece. In addition, the pieces of the air intake apparatus are made of resin and are joined to one another by a vibration welding. That is, a lower end surface (welding line) of an upper wall portion of the middle piece and an upper end surface (welding line) of a lower wall portion of the lower piece are vibration-welded to thereby constitute a side wall of the surge tank.

In the vibration welding, it is necessary to slidaly move (vibrate) joint portions of members that are joined to each other. A space for vibration is thus required in the vicinity of the joint portions. Accordingly, in the aforementioned air intake apparatus of JP2012-251518A, the side wall of the surge tank constituted by the upper wall portion of the middle piece and the lower wall portion of the lower piece, and a side wall of the downstream portion (downstream side end portion) of the air intake passage of the middle piece at which the flange portion is provided are formed to be spaced away from each other at an interval for joining.

DOCUMENT OF PRIOR ART

Patent Document

Patent document 1: JP2012-251518A

OVERVIEW OF INVENTION

Problem to be Solved by Invention

In recent years, because of a demand for design of a vehicle at which the air intake apparatus is mounted, for example, a space reduction of an engine space including the air intake apparatus is strongly desired. Nevertheless, according to the known air intake apparatus such as disclosed in JP2012-251518A, for example, two thick portions (wall portions) formed by the side wall of the surge tank and the side wall of the downstream portion (downstream side end portion) of the air intake passage are necessarily arranged to be spaced away from each other at an interval for joining. Thus, the air intake apparatus is enlarged by the interval (space) for joining, which results in a problem that a downsizing of the air intake apparatus is difficult. In addition, according to the aforementioned known air intake apparatus disclosed in JP2012-251518A, for example, the flange portion serving as a connection portion relative to the air intake port of the internal combustion engine is provided at a position spaced away from the side wall of the surge tank of the middle piece. Thus, a construction which easily causes a vibration is obtained because a vibration transmission portion (flange portion) during an operation of the internal combustion engine and a mass portion of the air intake apparatus are connected via the long air intake passage over a long distance, which results in a problem that it is difficult to restrain the vibration of the air intake apparatus.

The present invention is made to solve the drawback mentioned above and one object of the invention is to provide an air intake apparatus that is reduced in size and that is able to restrain a vibration.

Means for Solving Problem

In order to achieve the aforementioned object, an air intake apparatus according to a first aspect of the invention includes a first piece, an intermediate piece constituting a surge tank and joined to the first piece, and a second piece including an air intake passage upstream portion in communication with the surge tank, the second piece being joined to the intermediate piece. The first piece and the intermediate piece constitute an air intake passage downstream portion in communication with the air intake passage upstream portion. The second piece further includes a flange portion that connects the air intake passage downstream portion and an air intake port of an internal combustion engine.

The air intake apparatus according to the first aspect of the invention, as mentioned above, includes the air intake passage upstream portion in communication with the surge tank, and the flange portion that connects the air intake passage downstream portion and the air intake port of the internal combustion engine is formed at the second piece joined to the intermediate piece. In the second piece, a side wall in the vicinity of the air intake passage upstream portion that is in communication with the surge tank and a side wall of the flange portion are connected at least at a joint surface relative to the intermediate piece to form a single side wall. Therefore, also at the intermediate piece that is joined to the second piece, a side wall of the surge tank and a side wall of the air intake passage downstream portion are connected to form a single side wall which may be joined to the single side wall of the second piece. Accordingly, one of the two wall portions (the side wall of the surge tank and the side wall of the air intake passage downstream portion) which are conventionally required and an interval for joining in a case where the two wall portions are provided may be deleted to thereby expect a downsizing of the air intake apparatus. In addition, with the same size as a known air intake apparatus, the air intake apparatus that includes a further improved air intake performance is obtainable. As a result, design flexibility upon mounting the air intake apparatus at a limited space may increase, thereby improving mountability (easiness of mounting) of the air intake apparatus. Further, according to the present invention, the flange portion is provided at the second piece so that a vibration transmission portion (flange portion) and a mass portion (portion at the surge tank side) of the air intake apparatus may be connected by a short distance at the second piece, thereby restraining a vibration of the entire air intake apparatus.

In the air intake apparatus according to the aforementioned first aspect, favorably, the flange portion of the second piece and a wall portion of the surge tank or the air intake passage upstream portion of the second piece are adjoined to be integrally formed, the wall portion being formed at a side where the flange portion is provided, and a first joint portion that is joined relative to the intermediate piece is formed at a portion where the flange portion of the second piece and the wall portion of the surge tank or the air intake passage upstream portion of the second piece are adjoined to be integrally formed. According to the aforementioned construction, the flange portion and a second piece side portion of the surge tank or the air intake passage upstream portion may be integrally formed without separating from each other to thereby expect the downsizing. In addition, because the flange portion serving as the connection portion with the air intake port of the internal combustion engine is integrally formed with the second piece side portion of the surge tank or the air intake passage upstream portion in the second piece, a rigidity of the entire air intake apparatus may improve, which results in effective restraint of the vibration of the air intake apparatus at the time of driving of the internal combustion engine.

In this case, favorably, the surge tank of the intermediate piece and the air intake passage downstream portion of the intermediate piece are arranged to be adjoined via a single first partition wall, the first partition wall including a second joint portion that is joined to the first joint portion of the second piece. According to the aforementioned construction, not only at the second piece but also at the intermediate piece, the surge tank and the air intake passage downstream portion may be integrally formed by the single (common) first partition wall. As a result, the air intake passage downstream portion and the surge tank may be integrally formed via the single (common) partition wall in a wide range over a side surface of the surge tank at the side where the flange portion is provided (air intake passage downstream portion side). The downsizing of the air intake apparatus may be easily expected and the mountability of the air intake apparatus may be easily enhanced. Further, in addition to the second piece, the surge tank of the intermediate piece and the air intake passage downstream portion are adjoined so that the first partition wall therebetween is integrally formed. Thus, the rigidity of the entire air intake apparatus may be easily enhanced.

In the aforementioned construction where the surge tank and the air intake passage downstream portion are adjoined to each other via the single first partition wall, favorably, the surge tank includes the first partition wall, a first surge tank wall portion at an opposite side from the first partition wall, and a second surge tank wall portion connecting an end portion of the first partition wall and an end portion of the first surge tank wall portion, and the first partition wall and the second surge tank wall portion together divide and define the surge tank and the air intake passage downstream portion. According to the aforementioned construction, the surge tank and the air intake passage downstream portion may be integrally formed by the common partition wall in the wide range by the first partition wall and the second surge tank wall portion. Thus, the air intake apparatus may be further downsized and the rigidity of the air intake apparatus may be easily enhanced.

In the aforementioned construction where the first partition wall includes the second joint portion that is joined to the first joint portion of the second piece, favorably, the first partition wall is formed to linearly extend from the second joint portion on a longitudinal section along the air intake passage upstream portion and the air intake passage downstream portion. According to the aforementioned construction, the configuration of the first partition wall may be simplified. In a case where the intermediate piece is formed by a resin molding, for example, the first partition wall and the second joint portion may be easily formed.

In the aforementioned construction where the first partition wall includes the second joint portion that is joined to the first joint portion of the second piece, favorably, a thickness of the second joint portion and a thickness of the first joint portion are equal to each other. According to the aforementioned construction, as long as the thickness of each of the second joint portion and the first joint portion is sufficiently secured for the joining of the first joint portion and the second joint portion each other, the air intake passage downstream portion and the surge tank may be integrally formed via the common partition wall having the thickness that is minimum required. As a result, the thickness of the partition wall portion is inhibited from increasing more than necessary.

In the aforementioned construction where the surge tank of the intermediate piece and the air intake passage downstream portion of the intermediate piece are adjoined via the single first partition wall, favorably, the air intake passage upstream portion includes a plurality of air intake passage upstream portions and the air intake passage downstream portion includes a plurality of air intake passage downstream portions, and the flange portion is formed to connect the plurality of air intake passage downstream portions to one another and is adjoined to be integrally formed relative to the wall portion of the surge tank at the side where the flange portion is provided. According to the aforementioned construction, each of the plural air intake passage upstream portions and the flange portion are not required to be integrally formed and the flange portion and the surge tank are simply integrally formed, thereby simplifying the construction of the second piece.

In this case, favorably, a downstream end portion of the air intake passage downstream portion at which the flange portion is provided and the surge tank are adjoined to be divided and defined by a common second partition wall. According to the aforementioned construction, in a case where a portion of the surge tank is formed at the second piece side, the surge tank and the air intake passage downstream portion may be adjoined via the second partition wall not only at the intermediate piece but also at the second piece. As a result, the downsizing of the entire air intake apparatus and the improvement of rigidity of the air intake apparatus may be expected.

In the air intake apparatus according to the aforementioned first aspect, favorably, the second piece includes a reinforcing rib provided to connect an outer surface of the flange portion at the side where the surge tank is provided and an outer surface of a wall portion of the surge tank or the air intake passage upstream portion, the wall portion being formed at the side where the flange portion is provided. According to the aforementioned construction, a portion between the flange portion serving as the connection portion with the air intake port of the internal combustion engine and the surge tank or the air intake passage upstream portion may be reinforced, thereby further increasing the rigidity of the air intake apparatus. As a result, the vibration of the entire air intake apparatus may be restrained. In addition, in a case where the flange portion (air intake passage downstream portion) is provided at the middle piece as in a known air intake apparatus, the flange portion and the surge tank or the air intake passage upstream portion of the lower piece serve as separate pieces, which inhibits the reinforcing rib from being integrally formed. On the other hand, according to the present invention, the flange portion and the second piece side portion of the surge tank or the air intake passage upstream portion are formed at the same second piece, thereby easily improving the rigidity of the air intake apparatus by a simple construction where only the reinforcing rib is provided.

In this case, favorably, the reinforcing rib is formed to extend not only to a portion of the second piece facing the surge tank but also to the outer surface of the wall portion of the second piece facing the air intake passage upstream portion. According to the aforementioned construction, the reinforcing rib may be provided in the wide range from the surge tank to the air intake passage upstream portion to thereby effectively improve the rigidity of the air intake apparatus.

In the aforementioned construction where the reinforcing rib extends to the outer surface of the wall portion of the second piece facing the air intake passage upstream portion, favorably, the reinforcing rib is formed to extend in a tangential direction towards the outer surface of the wall portion of the air intake passage upstream portion from an end portion of the flange portion at the side where the surge tank is provided. According to the aforementioned construction, the reinforcing rib may be provided in the wide range to thereby effectively improve the rigidity of the air intake apparatus.

In the aforementioned construction where the reinforcing rib extends to the outer surface of the wall portion of the second piece facing the air intake passage upstream portion, favorably, the air intake passage upstream portion includes a plurality of air intake passage upstream portions and the air intake passage downstream portion includes a plurality of air intake passage downstream portions, and the reinforcing rib includes a plurality of reinforcing ribs for connecting the flange portion and the respective wall portions of the plurality of air intake passage upstream portions. According to the aforementioned construction, in a case where the plural air intake passage upstream portions are provided, the rigidity may be also enhanced by each of the reinforcing ribs for each of the air intake passage upstream portions.

In the air intake apparatus according to the aforementioned first aspect, favorably, the air intake passage upstream portion of the second piece includes a tubular portion extending in an arc form along an air intake passage, and the flange portion is formed to be adjoined to the air intake passage upstream portion including the tubular portion extending in the arc form. According to the aforementioned construction, the second piece where the air intake passage upstream portion including the tubular portion extending in the arc form is formed may be obtained by the single piece with a usage of a mold core in a rotary slide type. In a case where the rotary slide type mold core is used, an engagement portion is necessarily provided at an outer surface of a molded article. The engagement portion is pressed in a rotation direction to perform a process for pulling out the molded article (tubular portion) from the mold core. On the other hand, according to the present invention, the flange portion provided at the second piece may be used as the engagement portion in the pull-out process. Thus, the engagement portion is not required to be separately provided at the outer surface of the second piece.

In this case, favorably, the tubular portion is formed so that a flow passage width of the tubular portion increases towards an upstream side from a downstream side. According to the aforementioned construction, a draft angle upon pull-out of the molded article (tubular portion) from the mold core may be formed at the tubular portion. In a case where the second piece is formed by the single piece, the second piece may be easily formed.

In the air intake apparatus according to the aforementioned first aspect, favorably, the first piece, the intermediate piece and the second piece are made of resin so that the first piece, the intermediate piece and the second piece are configured to be joined to one another. According to the aforementioned construction, the first piece, the intermediate piece and the second piece may be easily joined by a welding method such as the vibration welding, for example. In this case, one of the two wall portions (the side wall of the surge tank and the side wall of the air intake passage downstream portion) which are conventionally required and the interval for joining in a case where the two wall portions are provided may be deleted to thereby expect the downsizing and the improved mountability of the air intake apparatus.

In the present application, other construction as below than the air intake apparatus according to the aforementioned first aspect is considered.

That is, an air intake apparatus according to the other construction of the present application includes an air intake apparatus body portion at which a surge tank and an air intake passage that is in communication with the surge tank and is connected to an air intake port of an internal combustion engine is formed, the air intake passage being provided to extend by surrounding a periphery of the surge tank and to extend along a side surface of the surge tank at a downstream portion in the vicinity of a connection portion relative to the air intake port. The side surface of the surge tank and the downstream portion of the air intake passage are divided and defined by a single partition wall portion. According to the aforementioned construction, a side wall of the surge tank and a side wall of the downstream portion of the air intake passage may be connected to be divided and defined by the single partition wall portion. As a result, one of the two wall portions (the side wall of the surge tank and the side wall of the downstream portion of the air intake passage) which are conventionally required and an interval for joining in a case where the two wall portions are provided may be deleted to thereby expect the downsizing of the air intake apparatus. As a result, the design flexibility upon mounting the air intake apparatus at a limited space may increase, thereby improving the mountability (easiness of mounting) of the air intake apparatus. In addition, the surge tank and the downstream portion of the air intake passage may be integrally formed via the single partition wall portion without separating from each other. Thus, the rigidity of the entire air intake apparatus may improve and the vibration of the air intake apparatus may be restrained.

Effects of the Invention

According to the present invention, as mentioned above, an air intake apparatus that achieves a downsizing and a restraint of a vibration may be provided.

MODE FOR CARRYING OUT THE INVENTION

An embodiment of the present invention is explained below with reference to drawings.

With reference to FIGS. 1 to 5, a construction of an air intake apparatus 100 according to the embodiment of the present invention is explained. In the present embodiment, an example of the air intake apparatus mounted to an inline four-cylinder engine (not illustrated) for an automobile is explained.

Figure 1:
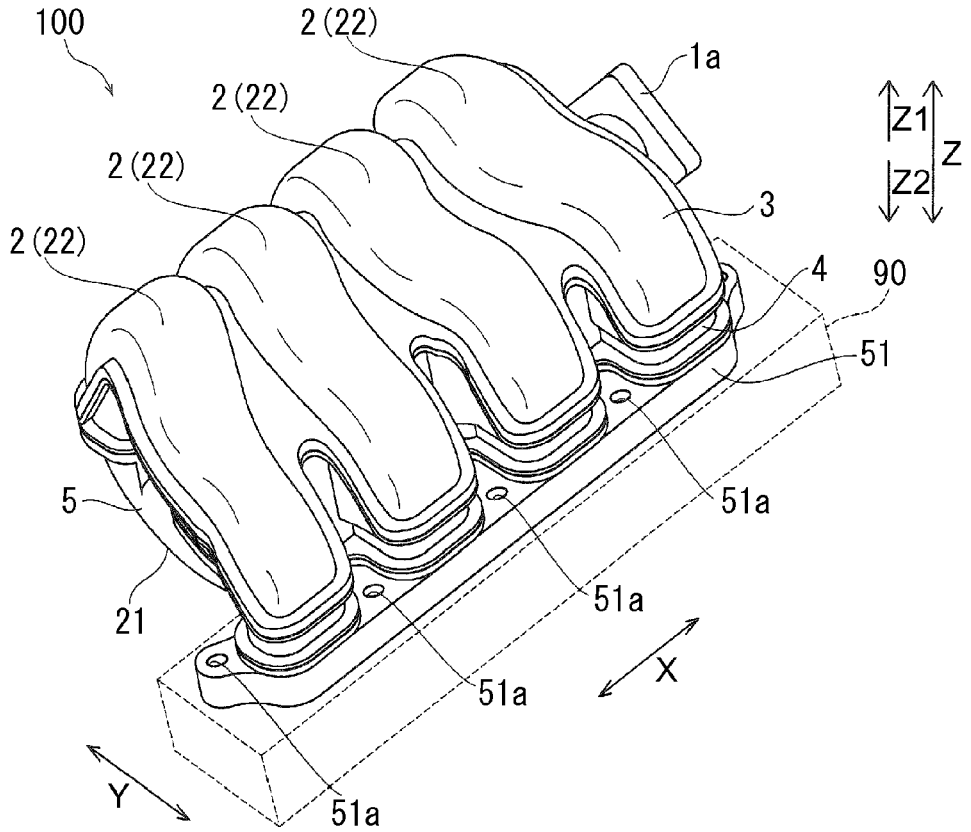
FIG. 1 A perspective view illustrating an air intake apparatus when viewed from upwardly according to an embodiment of the present invention.
Figure 2:
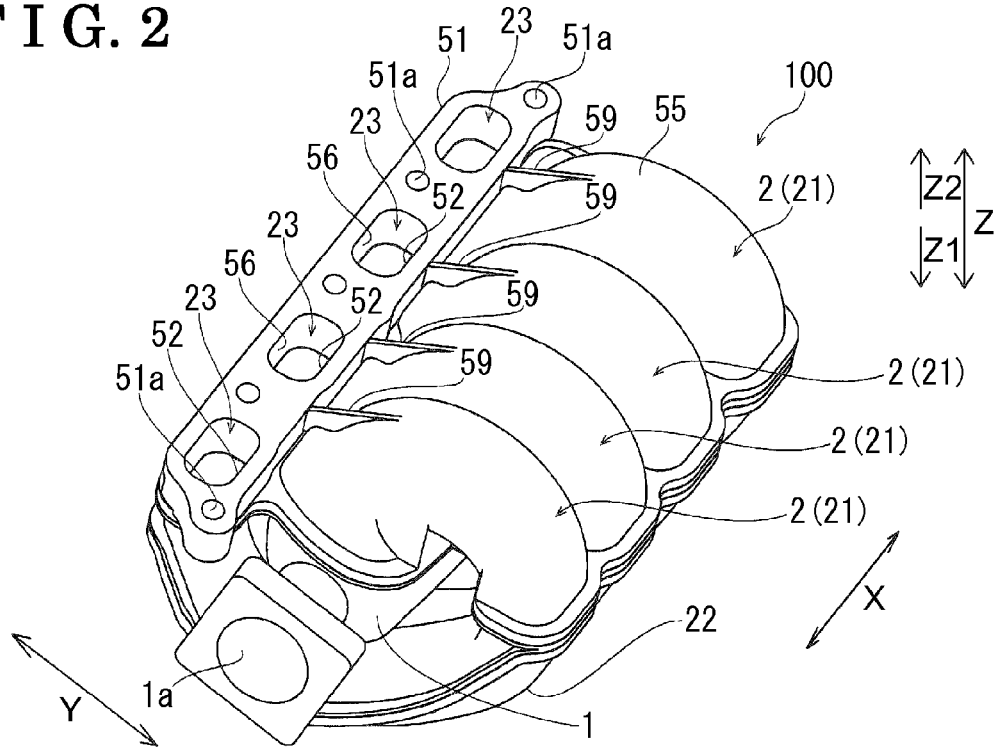
FIG. 2 A perspective view illustrating the air intake apparatus when viewed downwardly according to the embodiment of the present invention.
Figure 3:
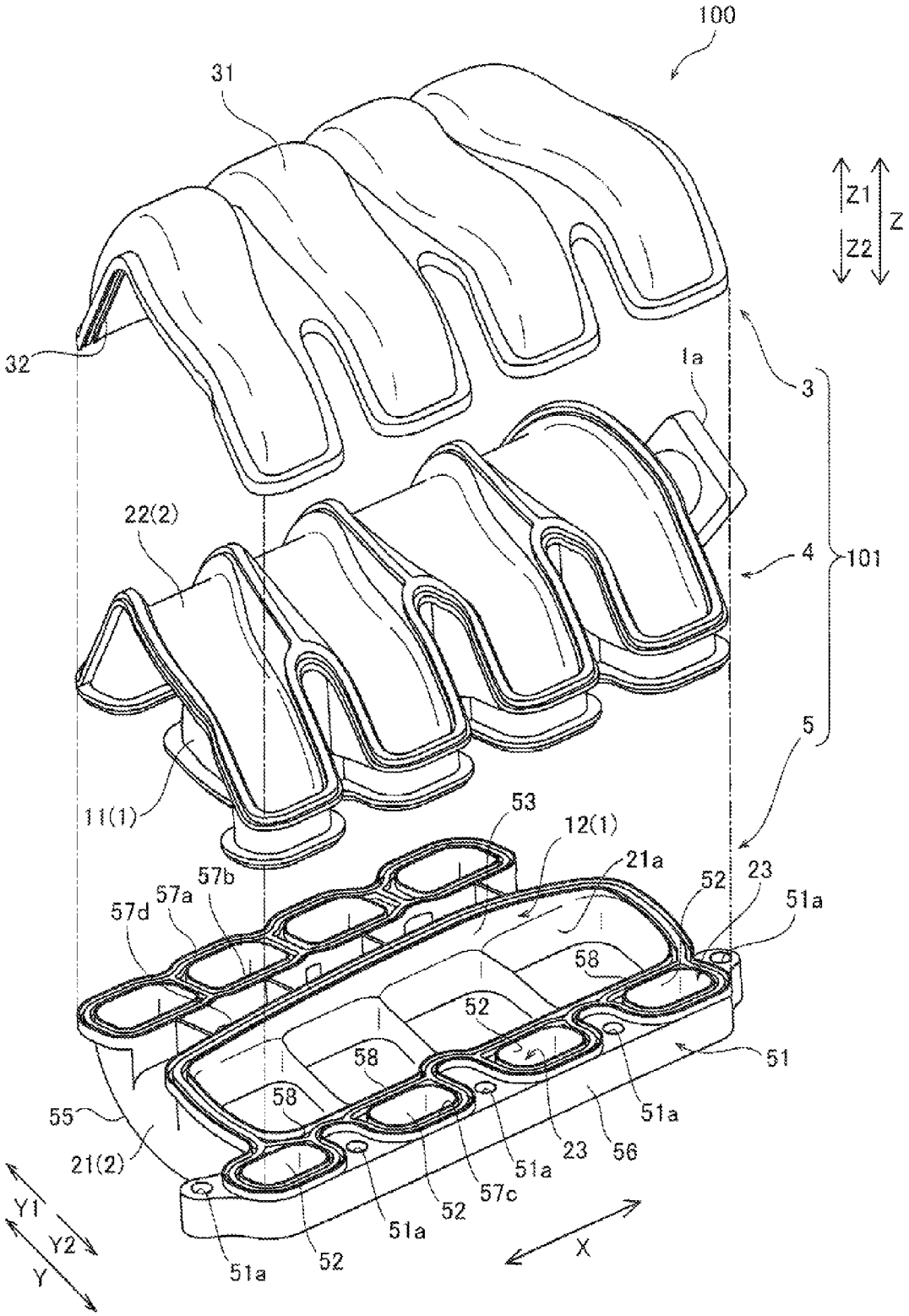
FIG. 3 An exploded perspective view illustrating a construction of the air intake apparatus according to the embodiment of the present invention.

As illustrated in FIGS. 1 to 3, the air intake apparatus 100 includes a surge tank 1 (see FIG. 2) and four air intake passages 2 branched from the surge tank 1 and arranged at a downstream of the surge tank 1. The air intake apparatus 100 is connected to a cylinder head 90 so that the four air intake passages 2 are configured to be connected to respective cylinders of the engine (internal combustion engine) via an air intake port 91 (see FIG. 4).

The air intake apparatus 100 includes a three-piece construction where an air intake apparatus body portion 101 is constituted by an upper piece 3, a middle piece 4 and a lower piece 5 as illustrated in FIG. 3. The upper piece 3, the middle piece 4 and the lower piece 5 are examples of a first piece, an intermediate piece and a second piece, respectively, of the present invention.

The upper piece 3, the middle piece 4 and the lower piece 5 are formed of a resin material so that the upper piece 3, the middle piece 4 and the lower piece 5 are configured to be joined to one another. For example, nylon 6 (PA6) or the like may be used as the resin material. The upper piece 3, the middle piece 4 and the lower piece 5 are integrally joined to one another by a vibration welding so as to form the air intake apparatus body portion 101. The air intake apparatus body portion 101 formed in the aforementioned manner integrally includes the surge tank 1 and the four air intake passages 2. In the following, for descriptive purposes, a direction X in which the four air intake passages 2 are arranged side by side is referred to as a lateral direction, a direction Z serving as a joining direction of the upper piece 3, the middle piece 4 and the lower piece 5 is referred to as an up-down direction (a direction Z1 at a side where the upper piece 3 is provided is an upper side, a direction Z2 at a side where the lower piece 5 is provided is a lower side), and a direction Y orthogonal to the direction X and the direction Z is referred to as a front-rear direction.

Figure 4:
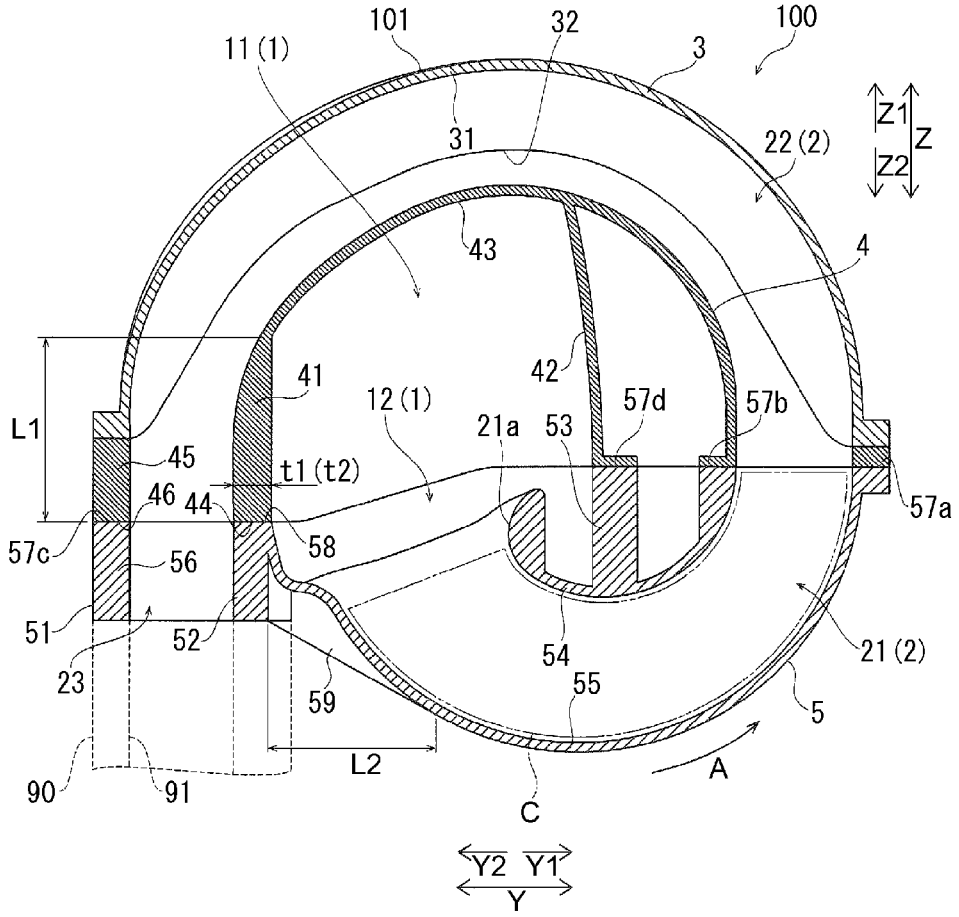
FIG. 4 A schematic longitudinal section view along an air intake passage of the air intake apparatus according to the embodiment of the present invention.

Intake air that arrives via an air clearer and a throttle (not illustrated) flows into the surge tank 1 from an intake 1*a* (see FIG. 2). On a longitudinal section along the air intake passage 2 (YZ section) as illustrated in FIG. 4, the surge tank 1 is defined by a partition wall (partition wall portions 41 and 52) at a side in a direction Y2, a partition wall (wall portions 42 and 53) at a side in a direction Y1, and a partition wall (wall portion 43) at a side in the direction Z1. The partition wall portion 41 is an example of a first partition wall of the present invention. The wall portions 42 and 43 are examples of a first surge tank wall portion and a second surge tank wall portion, respectively, of the present invention. The partition wall portion 52 is an example of a second partition wall of the present invention.

As illustrated in FIG. 1, the four air intake passages 2 are arranged side by side in the lateral direction. Each of the four air intake passages 2 is communicated with the surge tank 1 and includes an air intake passage upstream portion 21 and an air intake passage downstream portion 22 as illustrated in FIG. 4. The air intake passage upstream portion 21 is a passage portion that is communicated with the surge tank 1 at an upstream side end portion (inlet portion) 21*a* and that extends while curving in the direction Y1 from a lower portion of the surge tank 1. The air intake passage upstream portion 21 is integrally formed at the lower piece 5. In other words, in the air intake passage 2, the passage portion formed at the lower piece 5 is the air intake passage upstream portion 21 excluding a forming portion of a flange portion 51 which is explained later. The air intake passage upstream portion 21 is defined by wall portions 54 and 55 on the longitudinal section along the air intake passage 2 (YZ section). The air intake passage upstream portion 21 is an example of a tubular portion extending in an arc form of the present invention.

The air intake passage downstream portion 22 is a passage portion that is communicated with the air intake passage upstream portion 21 at an upstream side end portion thereof and that extends in the direction Y2 at an upper side of the surge tank 1 by surrounding a periphery of the surge tank 1 to arrive a downstream end portion 23. A neighboring portion (portion of a range L1) of the downstream end portion 23 (flange portion 51) of the air intake passage downstream portion 22 extends in the up-down direction (direction Z) along a side surface of the surge tank 1 at a side in the direction Y2. The air intake passage downstream portion 22 is defined by wall portions 31, 43, 45, 56 and the partition wall (partition wall portions 41 and 52) of the surge tank 1 at the side in the direction Y2 on the longitudinal section along the air intake passage 2 (YZ section).

Because of the aforementioned air intake passage upstream portion 21 and the air intake passage downstream portion 22, each of the air intake passages 2 is provided to extend by surrounding the periphery of the surge tank 1 and to extend along the side surface of the surge tank 1 at the air intake passage downstream portion 22 in the vicinity of a connection portion (flange portion 51) relative to the air intake port 91. In the present embodiment, the side surface of the surge tank 1 in the air intake apparatus body portion 101 at the side in the direction Y2, and a portion of the range L1 in the air intake passage downstream portion 22 and the downstream end portion 23 are divided and defined by a single partition wall constituted by the partition wall portions 41 and 52. In addition, the partition wall portion 41 and the wall portion 43 both divide and define the surge tank 1 and the air intake passage downstream portion 22.

Next, a construction of each of the pieces constituting the air intake apparatus body portion 101 is explained.

As illustrated in FIGS. 1 and 3, the upper piece 3 is provided to cover an upper side (in the direction Z1) portion of the middle piece 4 to constitute an upper side corresponding to substantially a half of the air intake passage downstream portion 22 of each of the four air intake passages 2 arranged side by side in the direction X. The upper piece 3 integrally includes the wall portion 31 that defines the air intake passage downstream portion 22 on the longitudinal section along the air intake passage 2 (YZ section) as illustrated in FIG. 4. In addition, the upper piece 3 is joined to the middle piece 4 at a joint portion 32.

As illustrated in FIG. 3, the middle piece 4 constitutes the surge tank 1. The middle piece 4 is joined to the upper piece 3 at an upper surface side and is joined to the lower piece 5 at a lower surface side. As illustrated in FIG. 4, an upper side portion 11 corresponding to substantially three-quarters of the surge tank 1 is formed at the middle piece 4. The middle piece 4 integrally includes the wall portions 42 and 43 defining the upper side portion 11 and the aforementioned partition wall portion 41 on the longitudinal section along the air intake passage 2 (YZ section). The wall portion 42 is arranged at an opposite side (in the direction Y1) from the partition wall portion 41 in the surge tank 1. The wall portion 43 connects an end portion of the partition wall portion 41 at a side in the direction Z1 and an end portion of the wall portion 42 at the side in the direction Z1. The middle piece 4 constitutes a lower side (in the direction Z2) corresponding to substantially a half of the air intake passage downstream portion of the air intake passage 2 of the air intake passage 2. Accordingly, the upper piece 3 and the middle piece 4 constitute the air intake passage downstream portion 22 which is in communication with the air intake passage upstream portion 21 excluding the downstream end portion 23 formed at the lower piece 5.

In addition, in the air intake passage downstream portion 22, the portion of the range L1 extending in the up-down direction (direction Z) along the side surface of the surge tank 1 in the direction Y2 and the upper side portion 11 of the surge tank 1 are arranged so as not to be spaced away from each other and to be adjoined to each other via the single partition wall portion 41. A second joint portion 44 is formed at a lower end surface of the partition wall portion 41 so as to be joined to a first joint portion 58, which is explained later, of the lower piece 5. The partition wall portion 41 is formed to extend linearly in the direction Z from the second joint portion 44 on the longitudinal section along the air intake passage 2 (the air intake passage upstream portion 21 and the air intake passage downstream portion 22) (YZ section). The air intake passage downstream portion 22 is defined by the partition wall portion 41 and the wall portion 45 (and the wall portion 31 of the upper piece 3) at the portion of the range L1 on the longitudinal section along the air intake passage 2 (YZ section). A joint portion 46 relative to the lower piece 5 is formed at a lower end surface of the wall portion 45. The partition wall portion 41 of the middle piece 4 includes a thickness t1 at the second joint portion 44. The thickness t1 is sufficient for joining the second joint portion 44 to the first joint portion 58 of the lower piece 5.

The lower piece 5 integrally includes the air intake passage upstream portions 21 in communication with the surge tank 1 as illustrated in FIGS. 2 and 3. The lower piece 5 is joined to a lower surface of the middle piece 4 at an upper surface side. As illustrated in FIG. 4, in the present embodiment, a lower side portion 12 corresponding to substantially one-quarters of the surge tank 1 is formed at the lower piece 5. In addition, the air intake passage upstream portion 21 in a substantially arc tubular form is entirely formed at the lower piece 5. Further, the downstream end portion 23 of the air intake passage downstream portion 22 including the flange portion 51 that connects the air intake passage downstream portion 22 and the air intake port 91 is integrally formed at the lower piece 5.

The lower piece 5 integrally includes the partition wall portion 52 and the wall portion 53 defining the lower side portion 12 that constitutes the surge tank 1 on the longitudinal section along the air intake passage 2 (YZ section) as illustrated in FIG. 4. The lower piece 5 also includes the wall portions 54 and 55 defining the air intake passage upstream portion 21. The lower piece 5 further includes the wall portion 56 defining the downstream end portion 23 together with the partition wall portion 52.

Here, the air intake passage upstream portion 21 of the lower piece 5 is formed by a tubular portion extending in an arc form along the air intake passage 2 and is formed in a manner that a flow passage width (interval between the wall portion 54 and the wall portion 55 on the longitudinal section along the air intake passage 2 illustrated in FIG. 4) increases gradually towards the upstream side from the downstream side. Accordingly, in the present embodiment, the air intake passage upstream portion 21 of the lower piece 5 can be formed in an air intake passage configuration by a single piece with a usage of a mold core C (see a chain double-dashed line in FIG. 4) including a rotary slide type. That is, the wall portion (wall portions 54 and 55) is formed in a tubular form around the mold core C conforming to the air intake passage upstream portion 21 and thereafter the lower piece 5 is rotated relative to the mold core C in a direction A and the mold core C is pulled out so that the air intake passage upstream portion 21 can be formed. The construction where the flow passage width of the air intake passage upstream portion 21 increases towards the upstream side functions as a draft angle of the mold core C. The lower piece 5 is joined to the upstream side end portion of the air intake passage downstream portion 22 of the middle piece 4 via joint portions 57*a* and 57*b* at a downstream side end portion of the air intake passage upstream portion 21.

Figure 5:
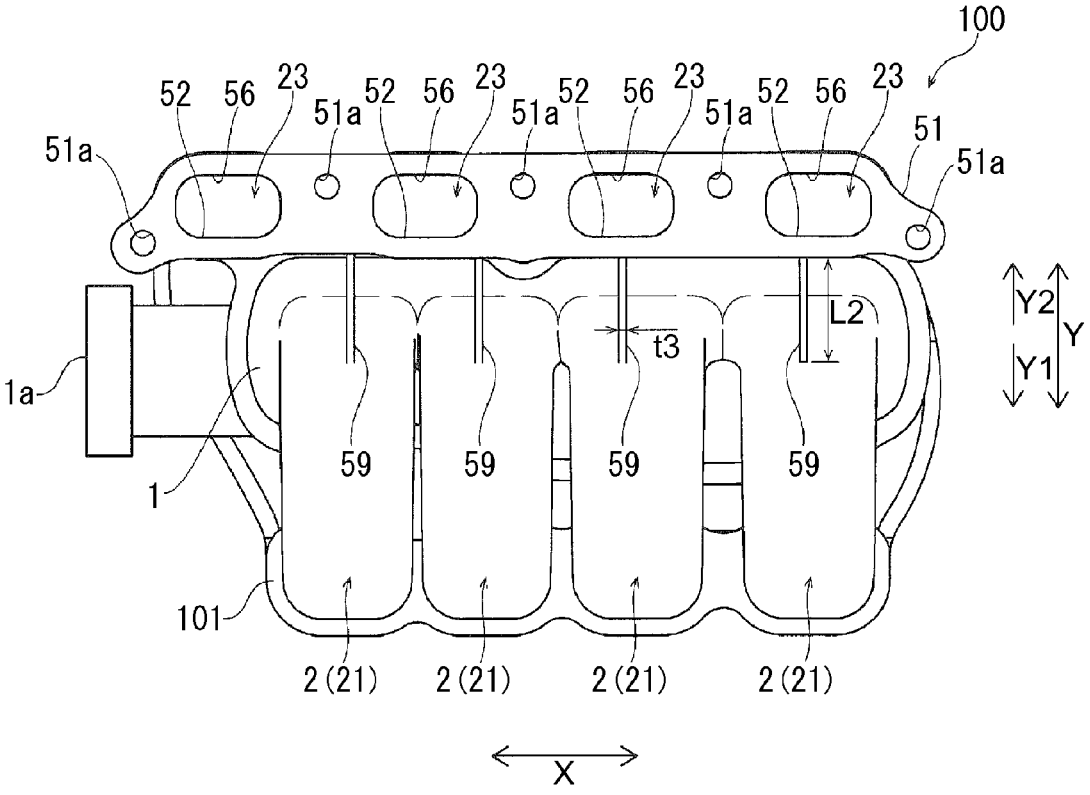
FIG. 5 A plan view illustrating a lower surface side of a lower piece of the air intake apparatus according to the embodiment of the present invention.

As illustrated in FIGS. 2 and 5, the flange portion 51 includes the partition wall portion 52 and the wall portion 56 at an outer peripheral portion of the downstream end portion 23 of the air intake passage downstream portion 22 so as to protrude outwardly (mainly in the direction X). Specifically, the flange portion 51 is formed to connect the respective downstream end portions 23 of the four air intake passages 2 in the direction X and to protrude outwardly further in the direction X at opposed end portions in the direction X. Then, plural bore portions 51*a* are formed at positions between the air intake passages 2 (downstream end portions 23) and positions at the opposed end portions in the direction X of the flange portion 51 so as to be connected to the cylinder head of the engine. Collars and fastening members which are not illustrated are inserted to be positioned within the bore portions 51*a* so that the air intake apparatus 100 is connected (fastened) to the engine side. The flange portion 51 is formed to be adjoined to the upstream side end portion of the air intake passage upstream portion 21 including a tubular configuration extending in an arc form on the longitudinal section along the air intake passage 2 (YZ section) as illustrated in FIG. 4.

Here, in the present embodiment, the flange portion 51 (downstream end portion 23) of the lower piece 5 and a wall portion of the lower side portion 12 of the surge tank 1 at the side where the flange portion 51 is provided (in the direction Y2) are adjoined to be integrally formed. That is, the flange portion 51 (downstream end portion 23) and the lower side portion 12 of the surge tank 1 are defined by the common partition wall portion 52 without separating in the direction Y. Accordingly, the flange portion 51 is provided to connect the plural air intake passage downstream portions 22 one another and is adjoined to be integrally formed at the wall portion of the surge tank 1 at the side where the flange portion 51 is provided. The first joint portion 58 is formed at an upper surface of the partition wall portion 52 at the lower piece 5 so as to be joined to the middle piece 4. Specifically, as illustrated in FIG. 3, a joining line of a wall portion constituting the flange portion 51 and the lower side portion 12 of the surge tank 1 is formed continuously without interruption at the upper surface of the lower piece 5. A portion of the joining line is the first joint portion 58, the portion being arranged at the partition wall portion 52 between the flange portion 51 and the lower side portion 12.

As illustrated in FIG. 4, the partition wall portion 52 of the lower piece 5 includes a thickness t2 at the first joint portion 58. The thickness t2 is substantially equal to the thickness t1 of the partition wall portion 41 of the middle piece 4 (t1=t2). In other words, the thickness t1 of the second joint portion 44 and the thickness t2 of the first joint portion 58 are substantially equal to each other. The thickness t2 is sufficient for joining the first joint portion 58 to the second joint portion 44 of the middle piece 4. On the longitudinal section along the air intake passage 2 (YZ section), the first joint portion 58 of the partition wall portion 52 and a joint portion 57*c* at an upper end surface of the wall portion 56 of the lower piece 5 are joined to the second joint portion 44 and the joint portion 46 of the middle piece 4, thereby constituting the air intake passage downstream portion 22 including the downstream end portion 23. In the same way, the lower piece 5 is joined to the middle piece 4 via the first joint portion 58 of the partition wall portion 52 and a joint portion 57*d* at an upper end surface of the wall portion 53, thereby constituting the surge tank 1 including the upper side portion 11 and the lower side portion 12.

As illustrated in FIGS. 2 and 5, in the present embodiment, a reinforcing rib 59 is formed at a portion among the flange portion 51, the lower side portion 12 of the surge tank 1 and the air intake passage upstream portion 21. The reinforcing rib 59 is integrally formed at the lower piece 5 so as to connect an outer surface of the flange portion 51 at the side (in the direction Y1) where the surge tank 1 (lower side portion 12) is provided and an outer surface of a wall portion for the lower side portion 12 and the air intake passage upstream portion 21 at the side where the flange portion 51 is provided (in the direction Y2). That is, as illustrated in FIG. 4, the reinforcing rib 59 is formed to extend not only to the outer surface of the lower side portion 12 of the lower piece 5 but also to the outer surface of the wall portion 55 of the air intake passage upstream portion 21. In addition, the reinforcing rib 59 is formed to extend in a tangential direction towards the outer surface of the wall portion of the air intake passage upstream portion 21 from an end portion of the flange portion 51 at the side where the surge tank 1 is provided. Specifically, the reinforcing rib 59 is formed over a wide range with a length L2 to an intersection point of a tangent line that is drawn from a lower end portion of the flange portion 51 at the side of the direction Y2 to the wall portion 55 of the air intake passage upstream portion 21. In addition, as illustrated in FIG. 5, the plural reinforcing ribs 59 are provided so as to connect the flange portion 51 to the respective wall portions of the plural air intake passage upstream portions 21. Specifically, the reinforcing ribs 59 are formed at the respective air intake passages 2 in the lower piece 5 so that the four reinforcing ribs 59 in total are provided. Each of the reinforcing ribs 59 is formed at a center portion of each of the air intake passages 2 in the direction X and includes a plate-formed configuration including a thickness t3.

Figure 6:
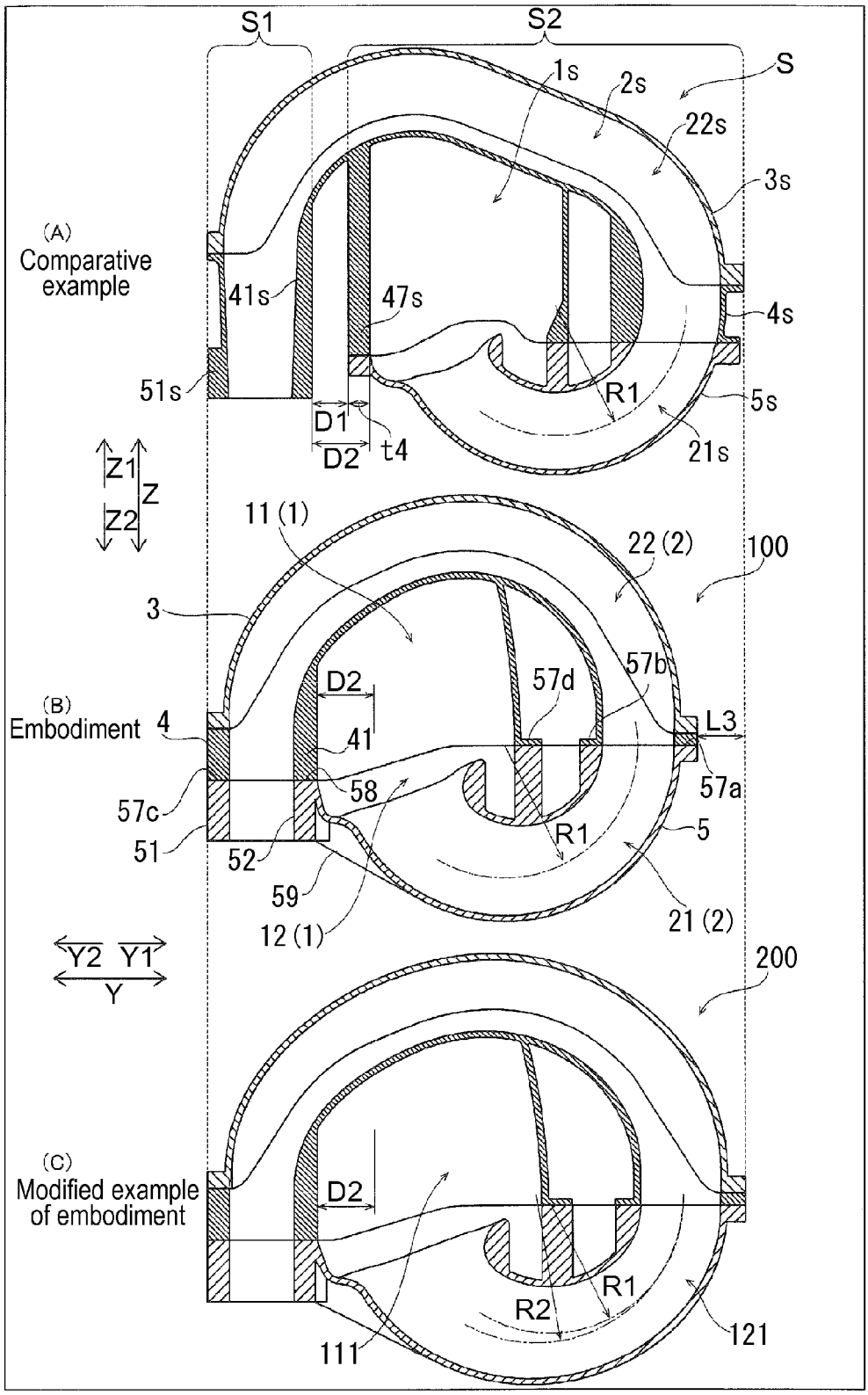
FIG. 6 (A) is a schematic longitudinal section view of an air intake apparatus according to a comparative example. (B) is a schematic longitudinal section view of the air intake apparatus according to the embodiment of the present invention. (C) is a schematic longitudinal section view of an air intake apparatus according to a modified example of the embodiment of the present invention.

Next, the air intake apparatus 100 according to the present embodiment and an air intake apparatus 200 according to a modified example of the present embodiment are compared with a comparative example and are explained with reference to FIG. 6.

FIG. 6(A) illustrates an air intake apparatus S where the flange portion is provided at the middle piece and the surge tank and the flange portion are spaced away in the direction Y at an interval D1. The air intake apparatus S according to the comparative example is an imaginary construction example where a known construction is employed only in a point where the flange portion is provided at the middle piece and the surge tank and the flange portion are away from each other in the direction Y. The other construction of the air intake apparatus S is approximated to the air intake apparatus 100 of the present embodiment for comparison.

FIG. 6(B) illustrates the air intake apparatus 100 of the present embodiment which is illustrated in FIGS. 1 to 5. FIG. 6(C) illustrates, as the modified example of the present embodiment, an air intake apparatus 200 which is reconstructed so that apparatus dimensions (dimensions in the direction Y) of the air intake apparatus 100 of the present embodiment match those of the air intake apparatus S of the comparative example.

As illustrated in FIG. 6(A), in the air intake apparatus S of the comparative example, a flange portion 51*s* is formed at a middle piece 4*s*. A lower piece 5*s* includes only an air intake passage upstream portion 21*s* and a lower side portion of a surge tank 1*s*. That is, the downstream end portion constituting a portion of an air intake passage downstream portion 22*s* is inhibited from being formed at the lower piece 5*s*. Thus, the lower piece 5*s* is joined to the middle piece 4*s* by the vibration welding at a side wall 47*s* of the surge tank 1*s*. As a result, in order to achieve the vibration welding by moving (sliding) the middle piece 4*s* and the lower piece 5*s* relative to each other at the side wall 47*s*, the side wall 47*s* of the surge tank 1*s* and a side wall 41*s* of the air intake passage downstream portion 22*s* are required to be spaced away from each other by the distance D1 as a space (relative movement allowance) for the vibration welding in the air intake apparatus S. In addition, the air intake apparatus S is illustrated as a construction example where a bending radius R1 of the air intake passage upstream portion 21*s* is substantially equal to the bending radius R1 of the air intake passage upstream portion 21 of the air intake apparatus 100 of the present embodiment as illustrated in FIG. 6(B). The bending radius illustrated here is a radius of an arc which substantially extends along a passage center line of the air intake passage. Because the flow passage width is not constant as mentioned above, a representative line (arc) as a guide of the bending radius is illustrated to be the radius of the arc.

As illustrated in FIG. 6(B), in the air intake apparatus 100 according to the present embodiment, the single partition wall (partition wall portions 41 and 52) defines between the air intake passage downstream portion 22 including the flange portion 51, and the surge tank 1. Thus, when viewed on the longitudinal section along the air intake passage 2 (YZ section), the lower piece 5 is joined to the middle piece 4 at the first joint portion 58, the joint portions 57*a*, 57*b*, 57*c* and 57*d*. In this case, no space is necessarily secured for the vibration welding at the inside of the air intake apparatus 100. Accordingly, in the air intake apparatus 100 according to the present embodiment, as compared to the air intake apparatus S, it is possible to secure an inner space for a distance D2 as a sum of a thickness t4 of the side wall 47*s* and the interval D1 so as to arrange the surge tank 1 and the air intake passage upstream portion 21.

Accordingly, in a case where the air intake apparatus 100 of the present embodiment and the air intake apparatus S of the comparative example each of which includes the same bending radius R1 of the air intake passage upstream portion 21 are compared with each other, the air intake apparatus 100 is downsized by a length L3 in the direction Y as a result of securing the inner space for the distance D2.

As illustrated in FIG. 6(C), as for the air intake apparatus 200 according to the modified example of the present embodiment, the air intake apparatus 200 of which the entire length in the direction Y is equalized with that of the air intake apparatus S of the comparative example, it is possible to secure the inner space for the distance D2 as a sum of the thickness t4 of the side wall 47*s* and the interval D1 so as to arrange a surge tank 111 and an air intake passage upstream portion 121, as compared with the air intake apparatus S. Accordingly, in the air intake apparatus 200 according to the modified example of the present embodiment, as a result of securing the inner space for the distance D2, the air intake passage upstream portion 121 is configured to include a bending radius R2 greater than the radius R1. In a case where the bending radius of the air intake passage upstream portion 121 is enlarged, an air intake resistance may be reduced to decrease a pressure loss. Accordingly, in the air intake apparatus 200 of the modified example of the present embodiment, it is possible to improve performance of the air intake apparatus as compared to the air intake apparatus S of the comparative example including the same dimensions. The air intake passage upstream portion 121 is an example of the tubular portion extending in the arc form of the present invention.

As illustrated in FIG. 6(A), the air intake apparatus S includes a construction where a portion S1 at the side in the direction Y2 of the air intake passage downstream portion 22*s* relative to the surge tank 1*s* and a portion S2 at the side in the direction Y1 where the surge tank 1*s* and the air intake passage upstream portion 21*s* are arranged are spaced away at the interval D1. Therefore, in a case where the air intake apparatus S is mounted to the engine side via the flange portion 51*s* serving as the connection portion relative to the cylinder head, a construction where the portion S1 at the side in the direction Y2 of the air intake apparatus S supports the portion S2 at the side in the direction Y1 (the surge tank 1*s* and the air intake passage upstream portion 21*s*) is obtained. That is, in a case where the air intake apparatus S is connected to the engine side via the flange portion 51*s*, the portion S2 at the side in the direction Y1 serving as a mass portion is supported at an end of the portion S1 at the side in the direction Y2 in a cantilever form. As a result, at the air intake apparatus S, it is difficult to restrain the vibration of the portion S2 at the side in the direction Y1.

On the other hand, in the air intake apparatus 100 of the present embodiment as illustrated in FIG. 6(B), no interval is formed between a portion at the side in the direction Y2 (air intake passage downstream portion 22) and a portion at the side in the direction Y1 (the surge tank 1 and the air intake passage upstream portion 21). The flange portion 51 serving as the connection portion and the portion at the side in the direction Y1 (the surge tank 1 and the air intake passage upstream portion 21) are integrally connected to each other at a shortest distance. Thus, as compared to the air intake apparatus S of the comparative example, rigidity of the entire air intake apparatus 100 is enhanced to thereby restrain the portion at the side in the direction Y1 serving as the mass portion from vibrating. The same is applied to the air intake apparatus 200 of the modified example illustrated in FIG. 6(C).

In the present embodiment, as mentioned above, the flange portion 51 connecting the air intake passage downstream portion 22 and the air intake port 91 is provided at the lower piece 5. Thus, at the lower piece 5, the side wall (side wall of the lower side portion 12) in the vicinity of the air intake passage upstream portion 22 in communication with the surge tank 1 and the side wall of the flange portion 51 are connected at the joint surface (first joint portion 58) between the lower piece 5 and the middle piece 4 so that the single side wall (partition wall portion 52) is formed. Thus, at the middle piece 4 which is joined to the lower piece 5, the side wall of the surge tank 1 (upper side portion 11) and the side wall of the air intake passage downstream portion 22 are connected to form the single side wall (partition wall portion 41) which may be joined to the single side wall (partition wall portion 52) of the lower piece 5. Accordingly, the downsizing of the air intake apparatus 100 is expected. In the present embodiment, the flange portion 51 is provided at the lower piece 5 so that the vibration transmission portion (flange portion 51) and the mass portion (portion at the surge tank 1 side) of the air intake apparatus 100 may be connected by a short distance at the lower piece 5, thereby restraining the vibration of the entire air intake apparatus 100.

In recent years, in view of design improvement of a vehicle at which the air intake apparatus is mounted, it is desired to downsize the air intake apparatus without restricting the design for mounting (improvement of mountability). According to the present embodiment, because the downsizing of the air intake apparatus is expected, the air intake apparatus that is downsized and that meets a request for design, such as the air intake apparatus 100 of the present embodiment illustrated in FIG. 6(B), for example, may be proposed.

Not only the bending radius of the air intake passage upstream portion but also a capacity of the surge tank, an opening area of an inlet portion (upstream side end portion) of the air intake passage upstream portion, a path length of the air intake passage, and the like influence the performance of the air intake apparatus and are required to be appropriately designed depending on a specification of the vehicle (engine) at which the air intake apparatus is mounted. Therefore, according to the aforementioned air intake apparatus 200 of the modified example of the present embodiment illustrated in FIG. 6(C), it is possible to improve design flexibility for meeting a required specification without the enlargement of dimensions of the apparatus. As a result, the design flexibility upon mounting the air intake apparatus 100 (200) at a limited space may increase, thereby improving the mountability (easiness of mounting) of the air intake apparatus.

In the present embodiment, as mentioned above, the flange portion 51 of the lower piece 5 and the wall portion of the surge tank 1 at the side where the flange portion 51 is provided in the lower piece 5 are adjoined by the partition wall portion 52 to be integrally formed. Then, the first joint portion 58 that is joined to the middle piece 4 is provided at the partition wall portion 52. Accordingly, the flange portion 51 and the lower side portion 12 of the surge tank 1 may be integrally formed without being separated from each other so that the downsizing may be easily expected. In addition, because the flange portion 51 serving as the connection portion with the air intake port 91 is integrally formed with the surge tank 1 (lower side portion 12) at the lower piece 5, the rigidity of the entire air intake apparatus 100 may improve, which restrains the vibration of the air intake apparatus 100 at the time of driving of the engine.

In the present embodiment, as mentioned above, the surge tank 1 (upper side portion 11) of the middle piece 4 and the air intake passage downstream portion 22 of the middle piece 4 are arranged to be adjoined via the single partition wall portion 41. Then, the second joint portion 44 that is joined to the first joint portion 58 of the lower piece 5 is provided at the partition wall portion 41. Accordingly, not only at the lower piece 5 but also at the middle piece 4, the surge tank 1 and the air intake passage downstream portion 22 may be integrally formed by the single (common) partition wall portion 41. As a result, the air intake passage downstream portion 22 and the surge tank 1 may be integrally formed via the single (common) partition wall (partition wall portions 41 and 52) in a wide range over the entire side surface of the surge tank 1 at the side where the flange portion 51 is provided (in the direction Y2). The downsizing may be easily expected and the mountability of the air intake apparatus 100 may be easily enhanced. In addition to the lower piece 5, the surge tank 1 (upper side portion 11) of the middle piece 4 and the air intake passage downstream portion 22 are adjoined so that the partition wall therebetween is integrally formed. Thus, the rigidity of the entire air intake apparatus 100 may be easily enhanced.

In the present embodiment, as mentioned above, the partition wall portion 41, the wall portion 42 at the opposite side from the partition wall portion 41, and the wall portion 43 connecting the end portion of the partition wall portion 41 and the end portion of the wall portion 42 are provided at the surge tank 1. Then, the partition wall portion 41 and the wall portion 43 are provided to divide and define the surge tank 1 and the air intake passage downstream portion 22. Accordingly, the surge tank 1 and the air intake passage downstream portion 22 may be integrally formed by the common partition wall in the wide range by the partition wall portion 41 and the wall portion 43. As a result, the air intake apparatus 100 may be further downsized and the rigidity of the entire air intake apparatus 100 may be easily enhanced.

In the present embodiment, as mentioned above, the partition wall portion 41 is formed to extend linearly from the second joint portion 44 on the longitudinal section along the air intake passage upstream portion 21 and the air intake passage downstream portion 22 (YZ section). Accordingly, the configuration of the partition wall portion 41 may be simplified. The partition wall portion 41 and the second joint portion 44 may be thus easily formed at a time of forming the middle piece 4.

In the present embodiment, as mentioned above, the thickness t1 of the second joint portion 44 and the thickness t2 of the first joint portion 58 are equalized with each other. Accordingly, as long as the thickness of each of the second joint portion 44 and the first joint portion 58 is sufficiently secured for joining the second joint portion 44 and the first joint portion 58 to each other, the air intake passage downstream portion 22 and the surge tank 1 may be integrally formed via the common partition wall (partition wall portions 41 and 52) having the thickness that is minimum required. As a result, the thickness of the partition wall portion is inhibited from increasing more than necessary.

In the present embodiment, as mentioned above, the plural air intake passage upstream portions 21 and the plural air intake passage downstream portions 22 are provided. Then, the flange portion 51 is provided to connect the plural air intake passage downstream portions 22 to one another, and the wall portion of the surge tank 1 (lower side portion 12) provided at the side where the flange portion 51 is provided and the flange portion 51 are adjoined to be integrally formed. Accordingly, each of the plural air intake passage upstream portions 21 and the flange portion 51 are not required to be integrally formed and the flange portion 51 and the surge tank 1 are simply integrally formed, thereby simplifying the construction of the lower piece 5.

In the present embodiment, as mentioned above, the downstream end portion 23 of the air intake passage downstream portion 22 where the flange portion 51 is provided and the surge tank 1 (lower side portion 12) are adjoined and divided by the common partition wall portion 52. Accordingly, not only at the middle piece 4 but also at the lower piece 5, the surge tank 1 and the air intake passage downstream portion 22 may be adjoined via the common partition wall portion 52. As a result, the downsizing of the entire air intake apparatus 100 and the rigidity increase of the air intake apparatus 100 may be expected.

In the present embodiment, as mentioned above, the reinforcing rib 59 connecting the outer surface of the flange portion 51 at the side where the surge tank 1 is provided (in the direction Y1) and the outer surface of the surge tank 1 (lower side portion 12) at the side where the flange portion 51 is provided (in the direction Y2) is formed at the lower piece 5. Accordingly, the portion between the flange portion 51 serving as the connection portion relative to the air intake port 91 and the surge tank 1 may be reinforced to thereby further improve the rigidity of the air intake apparatus 100. As a result, the entire air intake apparatus 100 may be further restrained. In a case where the flange portion 51*s* (air intake passage downstream portion 22*s*) is provided at the middle piece 4*s* as in the comparative example illustrated in FIG. 6(A), the flange portion 51*s* of the middle piece 4*s* and the lower piece 5*s* serve as separate pieces, which inhibits the reinforcing rib from being formed. On the other hand, according to the air intake apparatus 100 of the present embodiment illustrated in FIG. 6(B), the flange portion 51, the surge tank 1 (lower side portion 12) and the air intake passage upstream portion 21 are formed at the same lower piece 5. Thus, the simple construction where the reinforcing rib 59 is simply provided may easily improve the rigidity of the air intake apparatus 100.

In the present embodiment, as mentioned above, the reinforcing rib 59 is formed to extend over the range with the length L2 to the outer surface of the wall portion 55 facing the air intake passage upstream portion 21 of the lower piece 5. The reinforcing rib 59 may be provided in the wide range from the surge tank 1 to the air intake passage upstream portion 21 to thereby effectively improve the rigidity of the air intake apparatus 100.

In the present embodiment, as mentioned above, the reinforcing rib 59 is formed to extend in the tangential direction towards the outer surface of the wall portion of the air intake passage upstream portion 21 from the end portion of the flange portion 51 at the side where the surge tank 1 is provided. Accordingly, the reinforcing rib 59 may be provided in the wide range to thereby effectively improve the rigidity of the air intake apparatus 100.

In the present embodiment, as mentioned above, the plural reinforcing ribs 59 are provided to connect the flange portion 51 and the respective wall portions of the plural air intake passage upstream portions 21. Accordingly, in a case where the plural air intake passage upstream portions 21 are provided, the rigidity may be enhanced by each of the reinforcing ribs 59 for each of the air intake passage upstream portions 21.

In the present embodiment, as mentioned above, the air intake passage upstream portion 21 of the lower piece 5 is formed in the tubular configuration extending in the arc form along the air intake passage, and the flange portion 51 is formed to be adjoined to the air intake passage upstream portion 21 including the tubular configuration extending in the arc form. Accordingly, the lower piece 5 where the tubular portion extending in the arc form (air intake passage upstream portion 21) is formed may be formed by the single piece with the usage of the mold core C in the rotary slide type. Then, the flange portion 51 provided at the lower piece 5 may be used as an engagement portion in a pull-out process of the lower piece 5 and the mold core C (process for pulling out the lower piece 5 from the mold core C by rotating the lower piece 5 relative to the mold core C in the direction A (see FIG. 4)). Thus, the engagement portion for the pull-out is not required to be separately provided at the outer surface of the lower piece 5.

In the present embodiment, as mentioned above, the air intake passage upstream portion 21 is formed so that the flow passage width increases towards the upstream side from the downstream side. Accordingly, the draft angle upon pull-out of the molded article (tubular portion) from the mold core may be formed at the air intake passage upstream portion 21. As a result, the lower piece 5 may be easily formed.

In the present embodiment, as mentioned above, the upper piece 3, the middle piece 4 and the lower piece 5 are made of resin so as to be joined to one another. Accordingly, the upper piece 3, the middle piece 4 and the lower piece 5 may be easily joined by the vibration welding. In such the case, one of the two wall portions obtained by the side wall 47*s* of the surge tank 1*s* and the side wall 41*s* of the air intake passage downstream portion 22*s* where the flange portion 51*s* is formed in the comparative example of FIG. 6(A), and the interval D for joining in a case where the two wall portions are provided may be deleted. Thus, for the above (distance D2), the downsizing of the air intake apparatus 100 and the improvement of mountability may be expected.

The aforementioned effects of the present embodiment are obtainable in the same manner in the air intake apparatus 200 according to the modified example illustrated in FIG. 6(C) though a detailed explanation is omitted.

The embodiment disclosed here should be considered as an example at any point and not be restrictive. The scope of the present invention is indicated by the scope of claims and not indicated by the aforementioned explanation of the embodiment. Further, any changes within the scope of claims and meaning and range of an equivalent are included.

For example, in the aforementioned embodiment, the example where the air intake apparatus of the present invention is applied to the air intake apparatus for the inline four-cylinder engine for the automobile is explained. The present invention, however, is not limited to the above. The air intake apparatus of the present invention is applicable to the air intake apparatus for an internal combustion engine other than the engine for the automobile or is applicable to the air intake apparatus for an automobile engine other than the inline four-cylinder engine.

In addition, in the present embodiment, the example where the air intake apparatus includes the three-piece configuration of the upper piece, the middle piece and the lower piece is explained. The present invention, however, is not limited to the above. In the present embodiment, the air intake apparatus may be configured by four or more than four pieces.

Further, in the present embodiment, the example where the portion (lower side portion) of the surge tank and the air intake passage upstream portion are provided at the lower piece is explained. The present invention, however, is not limited to the above. Without the lower side portion of the surge tank, only the air intake passage upstream portion may be provided at the lower piece. In this case, the air intake passage upstream portion and the flange portion 51 (downstream end portion) may be configured to be divided and defined by the single partition wall portion.

Furthermore, in the present embodiment, the example where the reinforcing rib is provided between the flange portion and the surge tank (lower side portion) of the lower piece is explained. The present invention, however, is not limited to the above. In the present invention, the reinforcing rib may not be provided, at the lower piece, between the flange portion and the surge tank (lower side portion).

Furthermore, in the present embodiment, the example where the reinforcing rib is provided at the range with the length L2 (see FIG. 4) among the flange portion, the surge tank (lower side portion) and the air intake passage upstream portion of the lower piece is explained. The present invention, however, is not limited to the above. The reinforcing rib may be provided at a range with a length shorter than the length L2. For example, the reinforcing rib may be provided at a portion between the flange portion and the surge tank (lower side portion) without extending to the air intake passage upstream portion.

Furthermore, in the present embodiment, the example where the air intake passage upstream portion of the lower piece is formed in the tubular configuration extending in the arc form so that the single piece may be formed with the usage of the mold core including the rotary slide type is explained. However, the present invention is not limited to the above. The lower piece may be split in two in the up-down direction so that a top-side lower piece and a bottom-side lower piece are formed by a normal mold. Then, the top-side lower piece and the bottom-side lower piece are joined to each other to thereby form the lower piece. In this case, the split in two may be conducted at an intermediate portion of the air intake passage upstream portion 21 in the up-down direction in FIG. 4. The top-side lower piece including the flange portion 51 (downstream end portion 23), the lower side portion 12 of the surge tank 1 and the upper side portion of the air intake passage upstream portion 21, and the bottom-side lower piece including the lower side portion of the air intake passage upstream portion 21 are joined to each other to constitute the lower piece 5.

Furthermore, in the present embodiment, the example where the upper piece, the middle piece and the lower piece are made of the resin material so as to be joined to one another is explained. The present invention, however, is not limited to the above. In the present invention, the upper piece, the middle piece and the lower piece may be made of a material other than the resin material.

EXPLANATION OF REFERENCE NUMERALS

1, 111 surge tank
3 upper piece (first piece)
4 middle piece (intermediate piece)
5 lower piece (second piece)
21, 121 air intake passage upstream portion (tubular portion extending in an arc form)
22 air intake passage upstream portion
41 partition wall portion (first partition wall)
42 wall portion (first surge tank wall portion)
43 wall portion (second surge tank wall portion)
44 second joint portion
51 flange portion

52 partition wall portion (second partition wall)
58 first joint portion
59 reinforcing rib
91 air intake port
100, 200 air intake apparatus

The invention claimed is:

1. An air intake apparatus comprising:

a first piece;

an intermediate piece constituting a surge tank and joined to the first piece; and a second piece including an air intake passage upstream portion in communication with the surge tank, the second piece being joined to the intermediate piece; wherein the first piece and the intermediate piece constitute an air intake passage downstream portion in communication with the air intake passage upstream portion, the second piece further includes a flange portion that connects the air intake passage downstream portion and an air intake port of an internal combustion engine, the air intake passage upstream portion of the second piece includes a tubular portion extending in an arc form along an air intake passage, the flange portion is formed to be adjoined to the air intake passage upstream portion including the tubular portion extending in the arc form, the air intake passage upstream portion of the second piece is defined by two wall portions included in the second piece on a longitudinal section along the air intake passage, the flange portion of the second piece and a wall portion of the surge tank are adjoined to be integrally formed on the longitudinal section along the air intake passage, and a first joint portion that is joined relative to the intermediate piece is formed at a portion where the flange portion of the second piece and the wall portion of the surge tank are adjoined to be integrally formed.

2. The air intake apparatus according to claim 1, wherein the surge tank of the intermediate piece and the air intake passage downstream portion of the intermediate piece are arranged to be adjoined via a single first partition wall, the first partition wall including a second joint portion that is joined to the first joint portion of the second piece.

3. The air intake apparatus according to claim 2, wherein the surge tank includes the first partition wall, a first surge tank wall portion at an opposite side from the first partition wall, and a second surge tank wall portion connecting an end portion of the first partition wall and an end portion of the first surge tank wall portion, the first partition wall and the second surge tank wall portion together divide and define the surge tank and the air intake passage downstream portion.

4. The air intake apparatus according to either claim 2, wherein the first partition wall is formed to linearly extend from the second joint portion on a longitudinal section along the air intake passage upstream portion and the air intake passage downstream portion.

5. The air intake apparatus according to claim 2, wherein a thickness of the second joint portion and a thickness of the first joint portion are equal to each other.

6. The air intake apparatus according to claim 2, wherein the air intake passage upstream portion includes a plurality of air intake passage upstream portions and the air intake passage downstream portion includes a plurality of air intake passage downstream portions, the flange portion is formed to connect the plurality of air intake passage downstream portions to one another and is adjoined to be integrally formed relative to the wall portion of the surge tank at the side where the flange portion is provided.

7. The air intake apparatus according to claim 6, wherein a downstream end portion of the air intake passage downstream portion at which the flange portion is provided and the surge tank are adjoined to be divided and defined by a common second partition wall.

8. The air intake apparatus according to claim 1, wherein the second piece includes a reinforcing rib provided to connect an outer surface of the flange portion at the side where the surge tank is provided and an outer surface of a wall portion of the surge tank or the air intake passage upstream portion, the wall portion being formed at the side where the flange portion is provided.

9. The air intake apparatus according to claim 8, wherein the reinforcing rib is formed to extend not only to a portion of the second piece facing the surge tank but also to the outer surface of the wall portion of the second piece facing the air intake passage upstream portion.

10. The air intake apparatus according to claim 9, wherein the reinforcing rib is formed to extend in a tangential direction towards the outer surface of the wall portion of the air intake passage upstream portion from an end portion of the flange portion at the side where the surge tank is provided.

11. The air intake apparatus according to claim 9, wherein the air intake passage upstream portion includes a plurality of air intake passage upstream portions and the air intake passage downstream portion includes a plurality of air intake passage downstream portions, the reinforcing rib includes a plurality of reinforcing ribs for connecting the flange portion and the respective wall portions of the plurality of air intake passage upstream portions.

12. The air intake apparatus according to claim 1, wherein the tubular portion is formed so that a flow passage width of the tubular portion increases towards an upstream side from a downstream side.

13. The air intake apparatus according to claim 1, wherein the first piece, the intermediate piece and the second piece are made of resin so that the first piece, the intermediate piece and the second piece are configured to be joined to one another.

14. The air intake apparatus according to claim 1, wherein the air intake passage upstream portion is formed only in the second piece.

15. The air intake apparatus according to claim 1, wherein the surge tank is arranged between the air intake passage upstream portion and the air intake passage downstream portion on the longitudinal section along the air intake passage.

* * * * *